US007798461B2

(12) United States Patent
Hackney

(10) Patent No.: US 7,798,461 B2
(45) Date of Patent: Sep. 21, 2010

(54) ROTATING BRACKET ASSEMBLY FOR COLLAPSIBLE AND PERMANENT BUILDING-FRAME CONSTRUCTION

(76) Inventor: Michael P. Hackney, 1795 Ashdale Rd., Center Cross, VA (US) 22437

( * ) Notice: Subject to any disclaimer, the term of this patent is extended or adjusted under 35 U.S.C. 154(b) by 180 days.

(21) Appl. No.: 12/152,709

(22) Filed: May 17, 2008

(65) Prior Publication Data

US 2008/0277551 A1 Nov. 13, 2008

Related U.S. Application Data

(63) Continuation-in-part of application No. 11/455,395, filed on Jun. 19, 2006, now abandoned.

(51) Int. Cl.
*A47G 29/00* (2006.01)

(52) U.S. Cl. ..... 248/371; 248/397

(58) Field of Classification Search ..... 248/371, 248/397, 288.11, 291.1, 292.12, 284.1, 514, 248/349.1, 324; 403/116, 111, 52, 84, 86
See application file for complete search history.

(56) References Cited

U.S. PATENT DOCUMENTS

| | | | | |
|---|---|---|---|---|
| 2,837,304 | A * | 6/1958 | Goss, Sr. | 248/514 |
| 4,666,327 | A * | 5/1987 | Su | 403/24 |
| 6,357,712 | B1 * | 3/2002 | Lu | 248/291.1 |
| 6,988,701 | B1 * | 1/2006 | Lin | 248/521 |
| 7,540,806 | B2 * | 6/2009 | Tastad | 463/46 |
| 7,641,163 | B2 * | 1/2010 | O'Keene | 248/292.14 |
| 7,644,472 | B2 * | 1/2010 | Chang et al. | 16/330 |

* cited by examiner

*Primary Examiner*—Amy J Sterling
(74) *Attorney, Agent, or Firm*—Peter J. Van Bergen

(57) ABSTRACT

A rotating bracket assembly comprises first and second members, each of which defines a channel having opposing sides coupled to a common base. The first member is nested within the second member with adjacent opposing sides being hingedly coupled to one another so that the first member can freely rotate 360° relative to the second member to achieve a plurality of rotational positions. A first plurality of holes formed in the opposing sides of the first member at least partially align with a second plurality of holes formed in the opposing sides of the second member for each of the rotational positions.

17 Claims, 10 Drawing Sheets

ROTATING BRACKET ASSEMBLY FOR COLLAPSIBLE AND PERMANENT BUILDING-FRAME CONSTRUCTION

This is a continuation-in-part of application Ser. No. 11/455,395, filed Jun. 19, 2006 now abandoned. Pursuant to 35 U.S.C. §120, the benefit of priority from co-pending application Ser. No. 11/455,395 is hereby claimed for this application.

FIELD OF THE INVENTION

The invention relates generally to brackets used in constructing building frames, and more particularly to a rotating bracket assembly that can be used for both collapsible and permanent building-frame construction.

BACKGROUND OF THE INVENTION

At its most basic level, frame construction involves the joining of two structural members. Typically, the two structural members are elongated members joined together with an angle being formed therebetween. Joining of the two structural members is typically accomplished on-site using fasteners (e.g., nails, screws, etc.) or brackets and fasteners. In either case, the two structural members are fixed in their relationship to one another. It is well known in the art that such on-site construction is prone to human error. To combat on-site human error, some frame construction for new dwellings is being done off-site in controlled environments. For example, wall frames and roof trusses can be manufactured in a controlled factory environment and then shipped to a construction location. However, manufactured framing assemblies are large and bulky owing to the substantial air space between structural members.

Some frame construction must be done on-site. Room additions or home expansion projects usually require adding walls, floors, a roof(s), and securing them to existing construction. In order to add a roof for a new room to an existing structure, the shingles must be removed and the plywood covering the trusses removed so that additional trusses can tie into the existing trusses correctly. The prior art exposes the interior of the dwelling to the elements, and adds time to the project. Exposure of the interior of the dwelling to wind, rain, and snow can damage the dwellings walls, insulation, electrical circuits or any exposed appliances.

SUMMARY OF THE INVENTION

Accordingly, it is an object of the present invention to provide a bracket that can be used in frame construction.

Another object of the present invention is to provide a bracket that can be used for both off-site and on-site framing.

Still another object of the present invention is to provide a bracket for frame construction that reduces the amount of roof demolition required when adding on to an existing roof.

Other objects and advantages of the present invention will become more obvious hereinafter in the specification and drawings.

In accordance with the present invention, a rotating bracket assembly comprises first and second members. The first member defines a first channel having opposing sides coupled to a common base. Similarly, the second member defines a second channel having opposing sides coupled to a common base. The first member is nested within the second member with each of the opposing sides of the first member being adjacent to one of the opposing sides of the second member.

The adjacent opposing sides are hingedly coupled to one another so that the first member can freely rotate 360° relative to the second member to achieve a plurality of rotational positions. The first member and second member have holes formed therethrough in each of their opposing sides and common base. A first plurality of holes in the opposing sides of the first member at least partially align with a second plurality of holes in the opposing sides of the second member for each of the rotational positions.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

The invention consists of two separate components 101 and 201 that can be made of made of sheet metal (e.g., coiled sheet steel), a rigid plastic, or a rigid composite, the choice of which is not a limitation of the present invention. The two components are joined together during the manufacturing process to form one rotating bracket assembly. The joining process is completed by, for example, bending features of one component to trap features of another component as will be described further below.

Figure 1A:
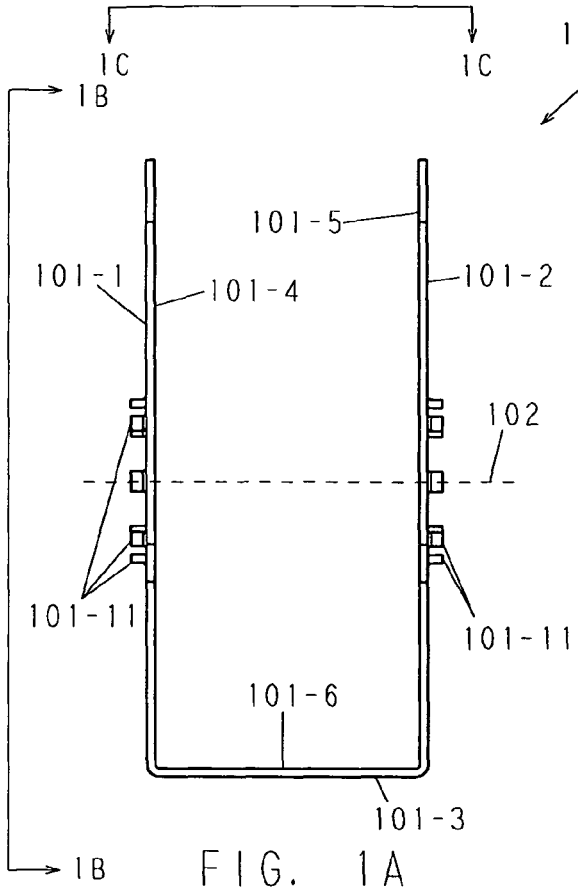
FIG. 1A is an end view of an embodiment of the first component of a rotating bracket assembly in accordance with the present invention.
Figure 1B:
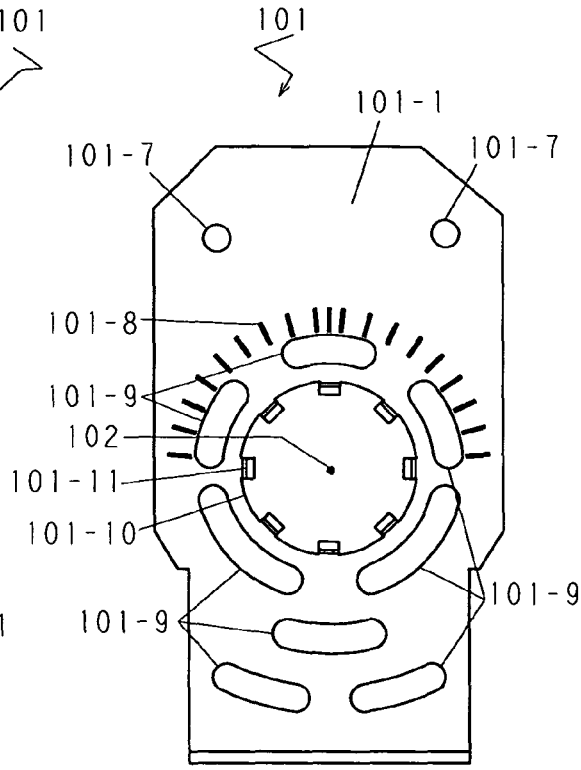
FIG. 1B is a side view of the first component taken along line 1B-1B in FIG. 1A.
Figure 1C:
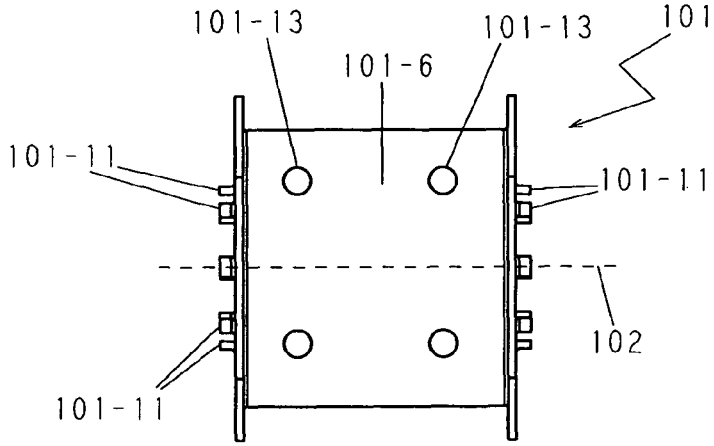
FIG. 1C is a top view of the first component taken along line 1C-1C in FIG. 1A.

FIGS. 1A-1C illustrate three views of one component 101. By way of example, component 101 can be made from a single piece of coiled sheet metal which is processed through a stamping die until most or all of the features are completed in ways well understood in the art. Component 101 is fabricated to have two opposing sides bent at right angles which are connected and separated by a common base having surfaces 101-3 and 101-6, such that interior and opposing surfaces 101-4 and 101-5 (of the sides) are parallel and mated with the offset distance determined by the width of surface 101-6. In this way, component 101 defines a U-shaped, rectangular channel sized to receive a framing member (not shown) as will be explained further below. In FIG. 1A, the large planar surfaces of component 101 are numbered 101-1 through 101-6. Surfaces 101-1 and 101-2 are parallel and are the exterior surfaces of the opposing sides of component 101 with interior surfaces 101-4 and 101-5 of the opposing sides opposing one another. Surfaces 101-1 and 101-4 comprise one side while surfaces 101-2 and 101-5 comprise the other side.

FIG. 1B is a view that illustrates surface 101-1. Note that the features visible at surface 101-2 are identical in position and size to those that would be visible on surface 101-1. Each feature 101-7 is a hole in both sides of component 101 such that a coincident axis passes through two aligned holes. By way of example, two features 101-7 are shown. However, it is to be understood that the number of features 101-7 may be increased or decreased as desired.

Feature 101-8 is angular position indicia and can be printed, formed by engraving punches during the stamping process, etc. This feature is for convenience and does not affect the function of the invention. This feature will be explained further below.

FIG. 1B further illustrates feature 101-10 that is a hole extending through surfaces 101-1/101-4 and 101-5/101-2 of component 101 such that a coincident axis 102 extends therethrough and is perpendicular to the sides of component 101. Feature 101-11 can be teeth, protrusions or tabs integrally formed on component around the circumference of hole 101-10. Prior to assembly of the present invention, tabs 101-11 are formed at right angles to surfaces 101-1 and 101-2 and protrude from both surfaces by, for example, approximately two times the material thickness of component 101.

Distributed concentrically around hole 101-10 and beneath hole 101-10 are a plurality of arcuate slots 101-9 that extend all the way through both sides of component 101. The number and size of each slot 101-9 can be other than shown without departing from the scope of the present invention.

FIG. 1C is top view of component 101 illustrating the common base thereof with a plurality of holes 101-13 extending all the way through the common base. Although four such holes 101-13 are shown, it is to be understood that fewer or more holes 101-13 can be provided. without departing from the scope of the present invention.

Figure 2A:
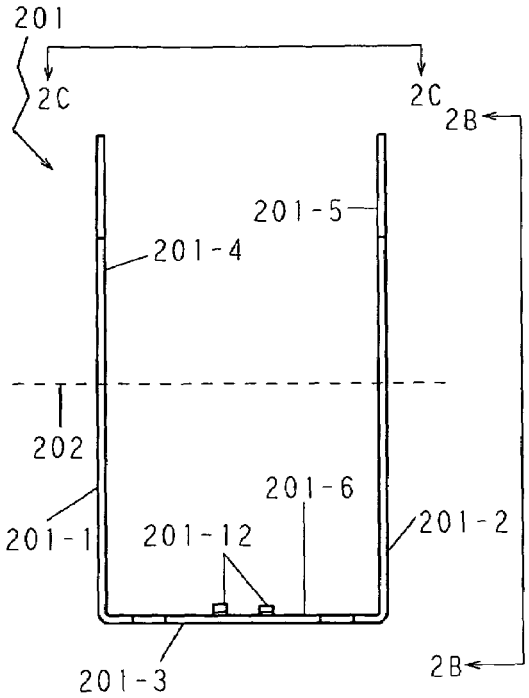
FIG. 2A is an end view of an embodiment of the second component of a rotating bracket assembly in accordance with the present invention.
Figure 2C:
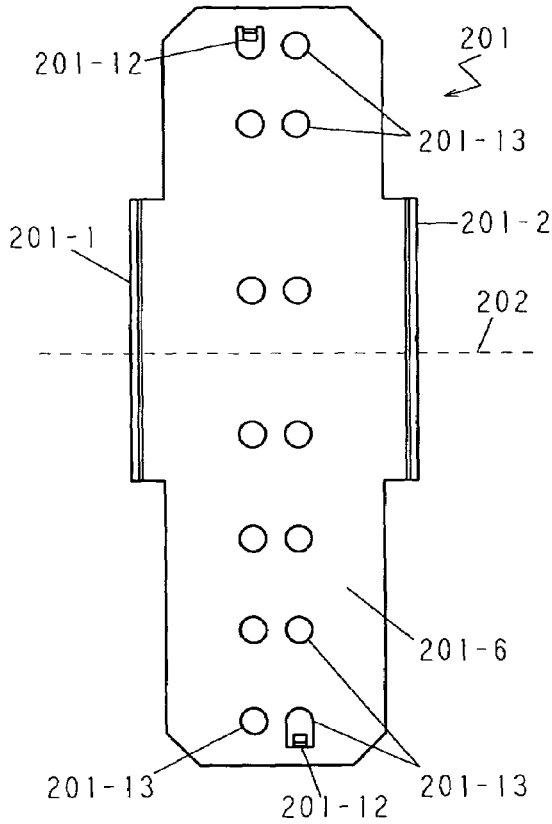
FIG. 2C is a top view of the second component taken along line 2C-2C in FIG. 2A.
Figure 2B:
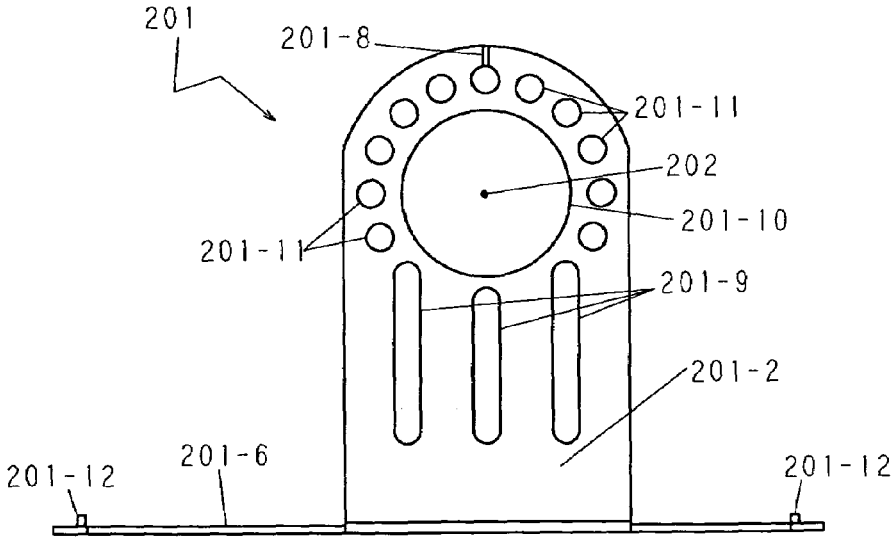
FIG. 2B is a side view of the second component taken along line 2B-2B in FIG. 2A.

FIGS. 2A-2C illustrate three views of the second component 201 that can also be made from, for example, a single piece of coiled sheet metal which is processed through a stamping die until most or all features are completed in ways well understood in the art. Component 201 has two sides that are bent at right angles to, connected to, and separated by surfaces 201-3 and 201-6 that define the common base of component 201. FIG. 2A shows the large planar surfaces of component 201 numbered for clarity. Exterior surfaces are 201-1, 201-2, and 201-3, and the interior surfaces are 201-4, 201-5, and 201-6. Exterior surfaces 201-1 and 201-2 are parallel as are opposing interior surfaces 201-4 and 201-5. In this way, component 201 defines a U-shaped, rectangular channel that is sized to allow component 101 to nest therein as will be explained further below.

FIG. 2B depicts the features visible on surface 201-2 with these features being identical in position and size to those visible on surface 201-1. Feature 201-8 is an angular position pointer that references a particular angular position indicia 101-8 (on component 101) when component 101 has been rotated to a selected position as will be explained further below. Features 201-11 are holes that extend through both sides of component 201. Features 201-11 are distributed about most of a hole 201-10 that extends through both sides of component 201. Each hole 201-11 in one side has a coincident axis with a hole in the opposing side of component 201. By way of example, eleven holes 201-11 are shown, although it is to be understood that more or fewer can be used. A coincident axis 202 extends through both holes 201-10 and is perpendicular to both sides of component 201. Each of holes 201-10 is sized to receive tabs 101-11 of component 101 when component 101 is nested within component 201 as will be explained further below. Each feature 201-9 is a vertical slot formed through both sides of component 201 beneath hole 201-10. Three slots 201-9 are shown, however, more or less could be provided without departing from the scope of the present invention.

FIG. 2C is a top view of component 201 illustrating the planar common base thereof with a plurality of holes 201-13 extending all the way through the common base. Fewer or more of holes 201-13 can be provided without departing from the scope of the present invention. In the illustrated embodiment, the planar common base of component 201 extends beyond the sides of component 201. However, it is to be understood that this is not a limitation of the present invention as the common base could be longer or shorter than illustrated, or could be non-planar. Although not required, one or more of holes 201-13 can have a tab 201-12 formed on an edge thereof that extends up from surface 201-6. The function of tab(s) 201-12 will be explained further below.

FIGS. 3A-3D illustrate several views of a rotating bracket assembly 300 in accordance with the present invention where common reference numerals are used for the above-described features of components 101 and 201 that comprise assembly 300 when joined together. Component 101 is nested within and coupled to component 201 by one of several methods. For example, a completely formed component 101 could be placed in an assembly fixture (not shown) along with an unshaped (e.g., flat) component 201. The two sides of component 201 would then be bent in the fixture. The fixture would position the two components accurately so that, when the sides of component 201 were bent at right angles, tabs 101-11 would protrude through hole 201-10. Tabs 101-11 would then be bent (i.e., in the case of metal fabrication of assembly 300) radially outward to couple components 101 and 201 with respective axes 102 and 202 being coincident with one another as is most readily seen in FIG. 3D.

After bending (i) the sides of component 201 over the sides of component 101 and (ii) tabs 101-11, assembly 300 of the invention is completed. As a result of such construction, component 101 can rotate 360° in either direction about coincident axes 102/202 (as indicated by rotational arrow 302) while remaining coupled to component 201.

Figure 3A:
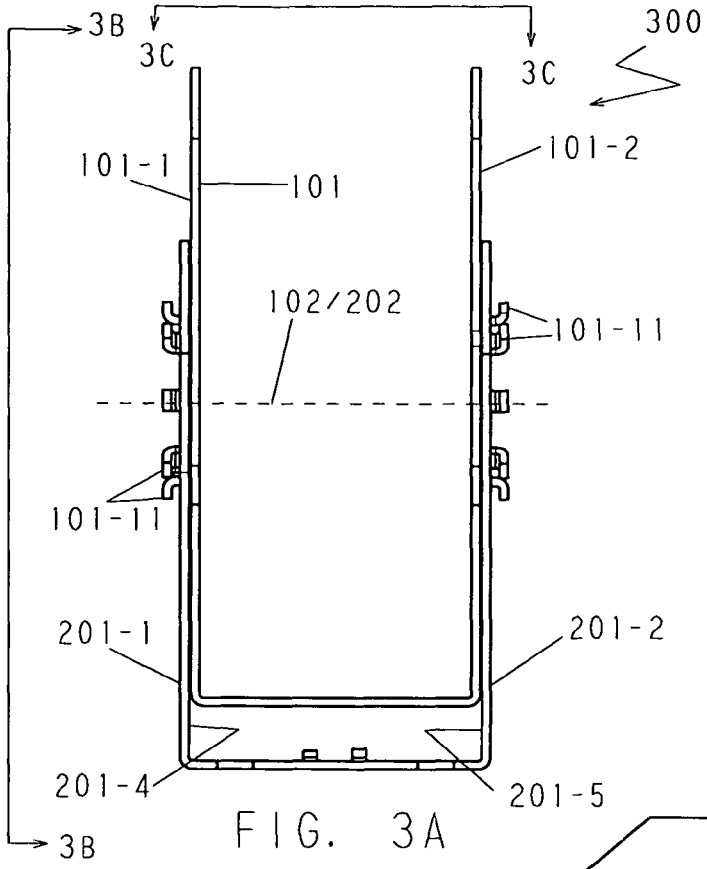
FIG. 3A is an end view of the rotating bracket assembly in accordance with an embodiment of the present invention.
Figure 3B:
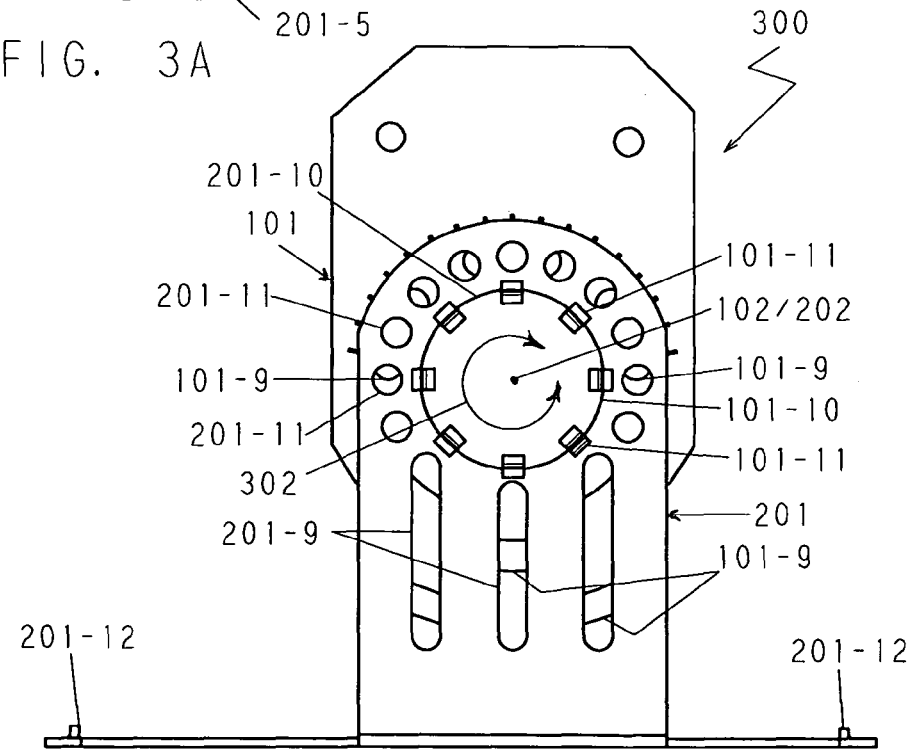
FIG. 3B is a side view of the rotating bracket assembly taken along line 3B-3B in FIG. 3A.
Figure 3C:
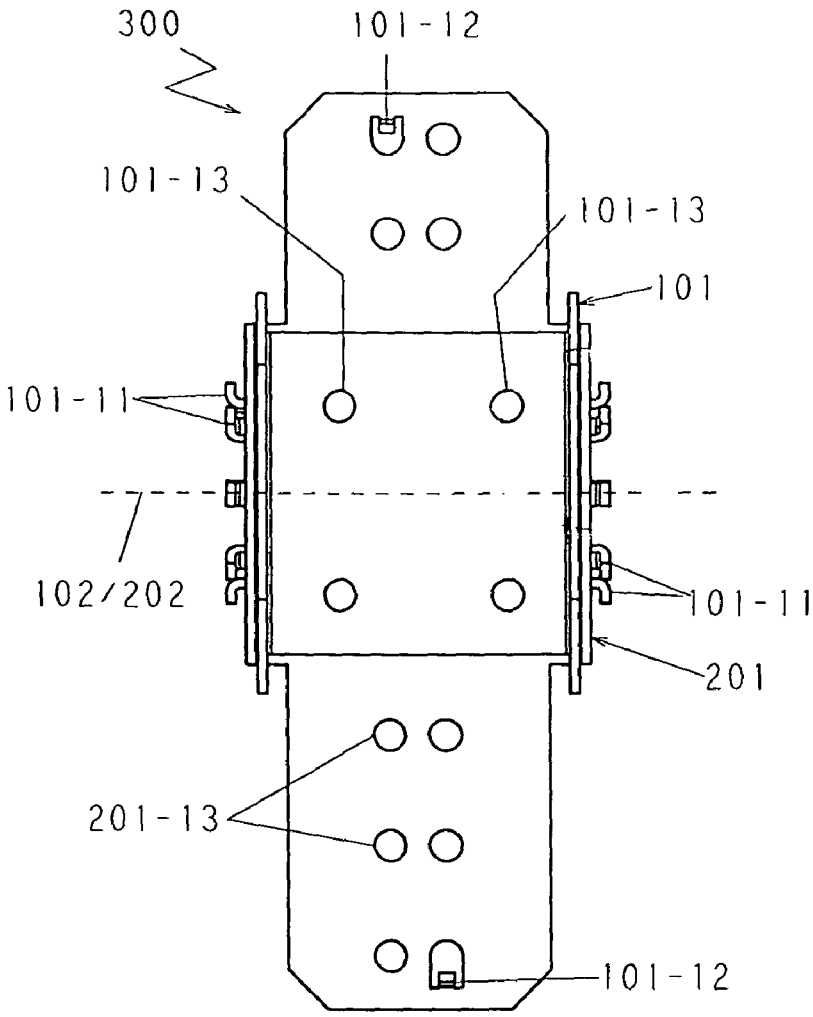
FIG. 3C is a top view of the rotating bracket assembly taken along line 3C-3C in FIG. 3A.
Figure 3D:
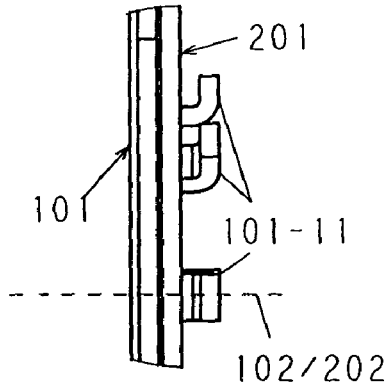
FIG. 3D is an enlarged side view of a portion of the rotating bracket assembly illustrating the first component's tabs in their bent position.
Figure 4:
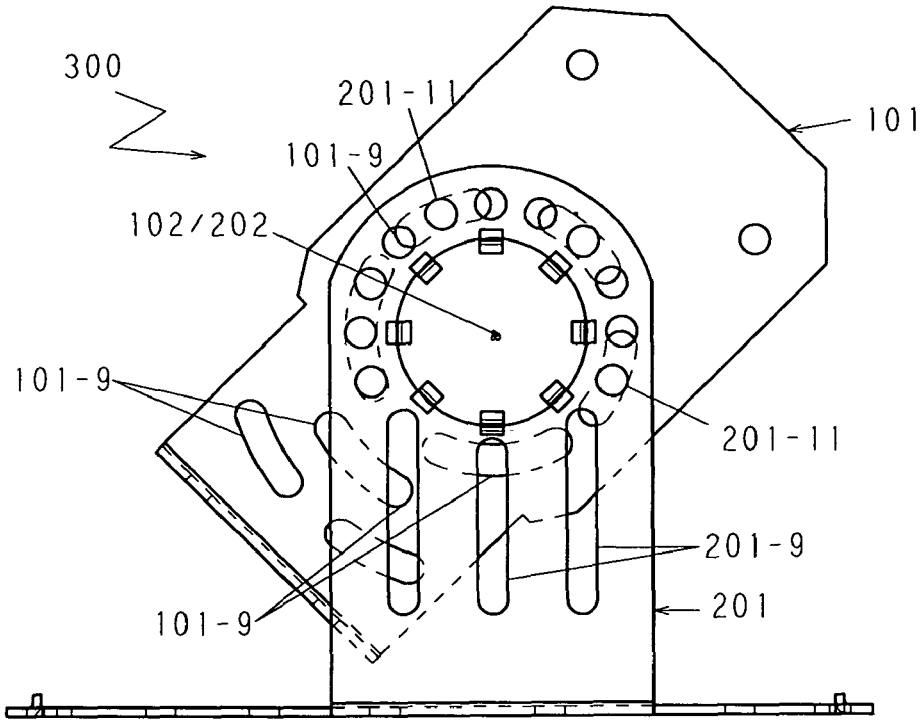
FIG. 4 is a side view of the rotating bracket assembly illustrating the first component rotated to a position relative to the second component.
Figure 5:
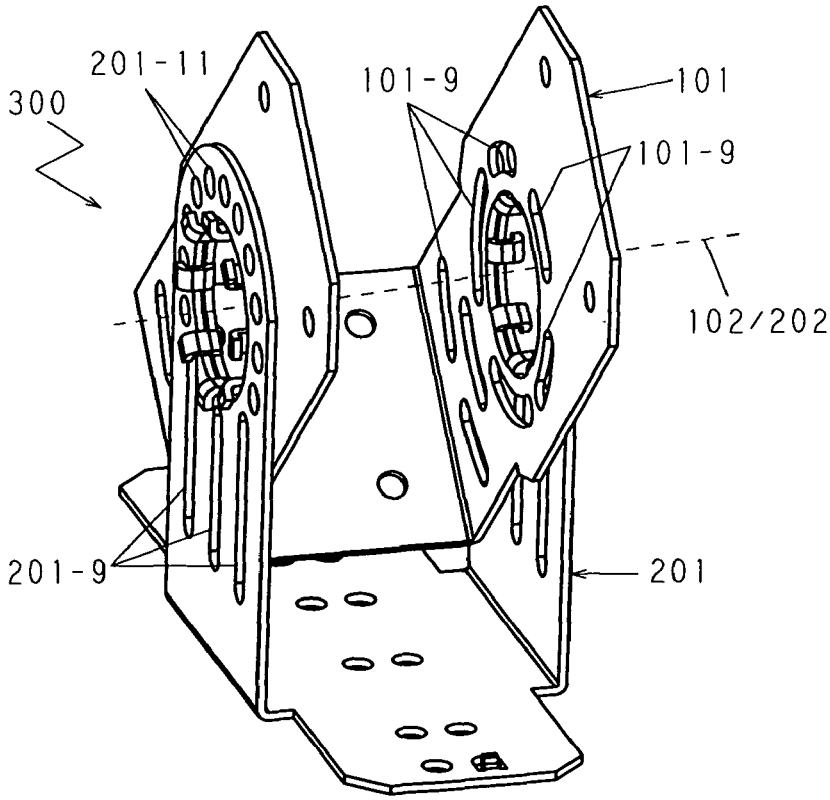
FIG. 5 is a perspective view of the rotating bracket assembly position illustrated in FIG. 4.

At any rotational position of component 101, a number of holes 201-11 and the upper portion of vertical slots 201-9 will be aligned with some portion of arcuate slots 101-9 distributed about hole 101-10. By way of illustrative examples, one such rotational position is shown in FIGS. 3A-3B while another is shown in FIGS. 4 and 5. In addition, at some rotational positions of component 101 (e.g., the rotational position illustrated in FIG. 3B) the lower portion of vertical slots 201-9 will be aligned with some portion of arcuate slots 101-9 provided beneath hole 101-10.

Figure 6:
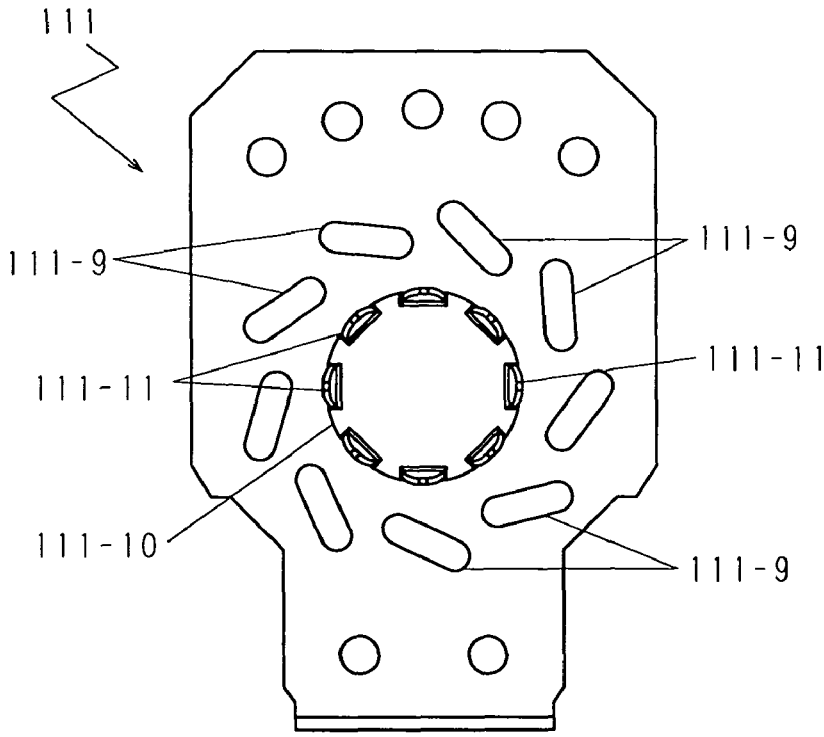
FIG. 6 is a side view of another embodiment of the first component of the rotating bracket assembly.
Figure 7:
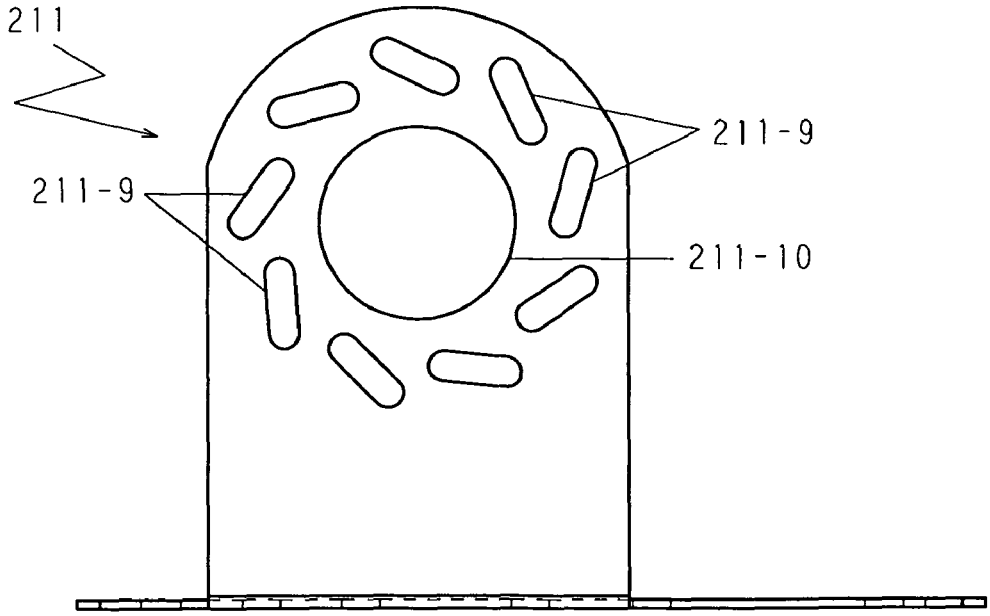
FIG. 7 is a side view of another embodiment of the second component of the rotating bracket assembly.
Figure 8:
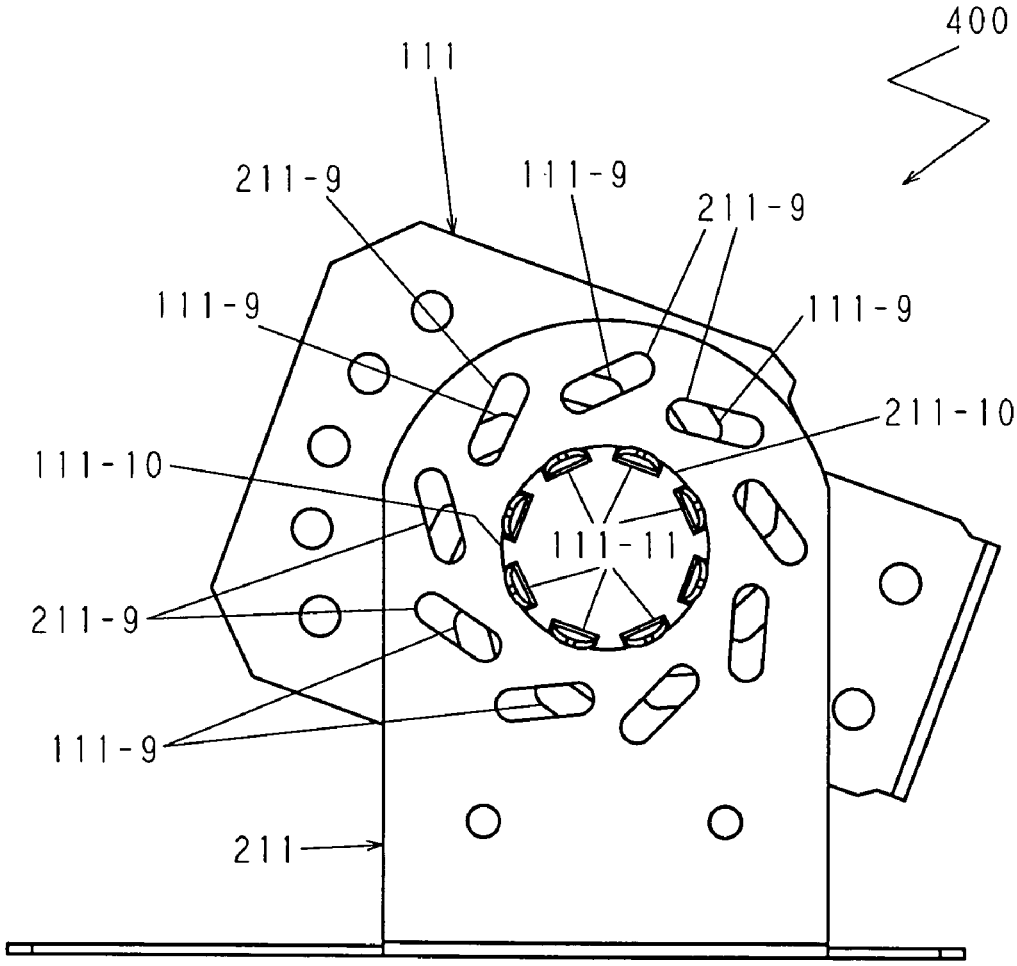
FIG. 8 is a side view of the rotating bracket assembly formed by the joining of the first and second components illustrated in FIGS. 6 and 7.

The present invention is not limited to the hole configurations described above. For example, referring now to FIGS. 6-8, another embodiment of the present invention is illustrated where FIG. 6 is an isolated side view of a component 111 that is analogous to component 101, FIG. 7 is an isolated side view of component 211 that is analogous to component 201, and FIG. 8 is a side view of rotating bracket assembly 400 formed when component 111 is nested in and rotationally coupled to component 211.

In this embodiment, straight slotted holes 111-9 are arranged about hole 111-10 and formed through each side of component 111. Similarly, straight slotted holes 211-9 are arranged about hole 211-10 and formed through each side of component 211. The number and size/length of each slotted hole is not a limitation of the present invention. Typically, the slotted holes will be the same size and be equal in number for each of components 111 and 211.

Slotted holes 111-9 and 211-9 are positioned such that, when assembly 400 is formed (i.e., with tabs 111-11 on component 111 engaging the edge of hole 211-10 of component 211), each of slotted holes 211-9 will be (i) over laid with at least one of slotted holes 111-9, and (ii) angularly disposed with respect to the overlaid one(s) of holes 111-9. As a result of this construction, rotating bracket assembly guarantees a plurality of aligned holes 111-9/211-9 will be evenly distributed about aligned holes 111-10/211-10.

The rotating-bracket assemblies of the present invention can be used in a variety of frame construction applications to include on-site and off-site constructions. On-site applications can include new-construction, renovations, and construction of additions. Off-site construction can include manufactured framing assemblies ready for on-site assembly as well as manufactured framing assemblies in a collapsed state that must be expanded and "locked" once on-site.

Several applications of the present invention will be described herein to illustrate the usefulness thereof. These applications will be described with reference to rotating bracket assembly 300. However, it is to be understood that the same applications could be realized using assembly 400.

For each use of assembly 300, holes 101-7, 101-13 and/or 201-13 can be used to fixedly attach assembly 300 to framing material (e.g., dimensional lumber, engineered wood members, metal members, etc.) using nails or screws. Note that such attachment does not impede rotation of component 101 with respect to component 201. Thus, even after assembly 300 is attached to the framing material, assembly 300 provides for rotational adjustment of the attached framing material. Such adjustment allows the framing material to be collapsed for compactness and allows the framing material to be angularly positioned for a particular application.

Once the designed angular position between the framing material is achieved, fasteners can be inserted through the aligned portions of slots 201-9/holes 201-11 with slots 101-9 to fix the angular position between the framing material. Specifically, fasteners (e.g., nails, screws, etc.) are inserted through the aligned holes and into the framing material from both sides of assembly 300. Since the holes/slots on both sides of assembly 300 are aligned, it may also be possible to use long fasteners that extend all the way across assembly 300 and through the framing material captured therein. Since attachment of assembly 300 to the framing material will occur at positions around the coincident axes 102/202 of rotation and on both sides of the framing material, structural loads are evenly distributed throughout assembly 300.

Figure 9:
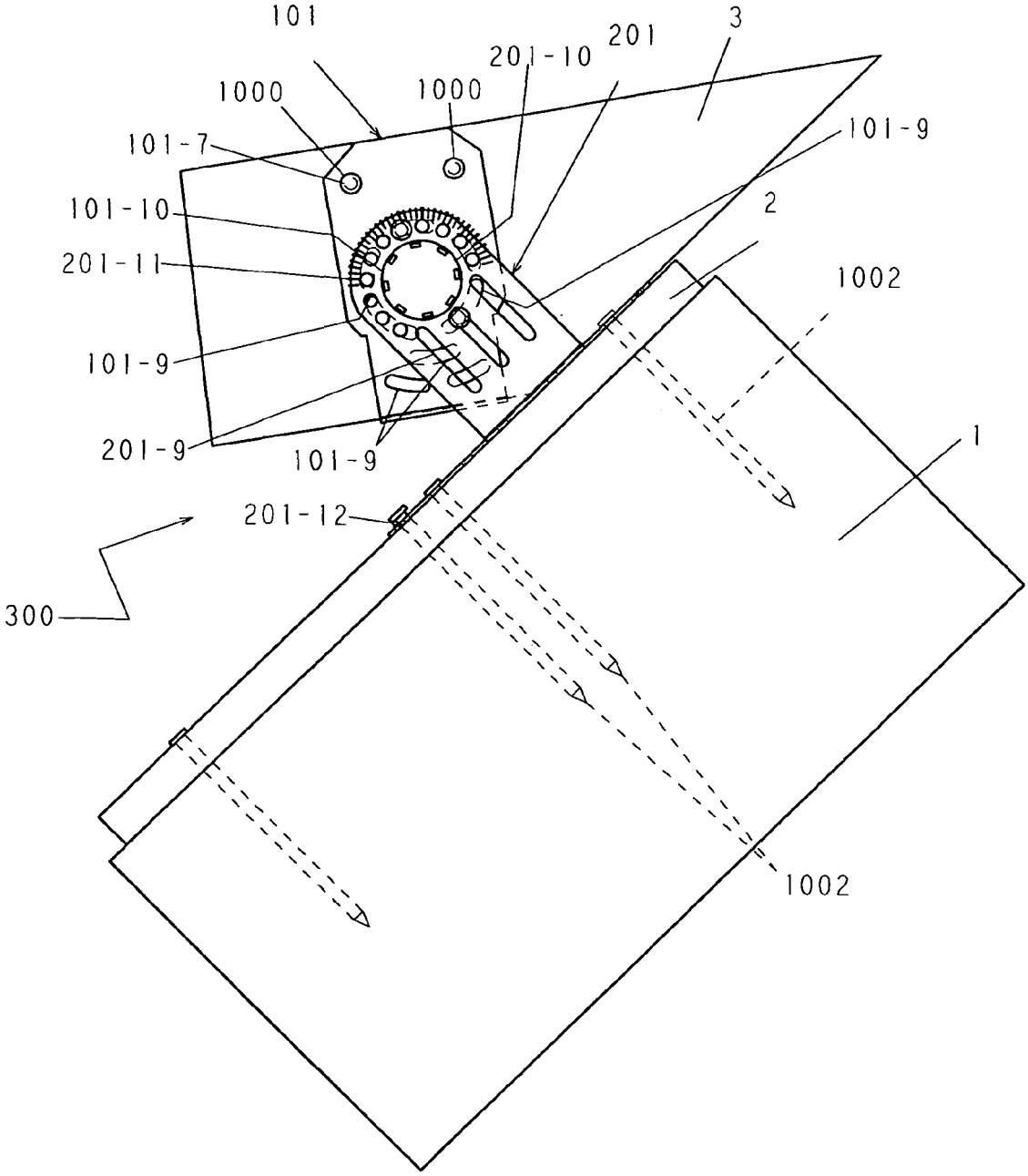
FIG. 9 is a side view of one embodiment of the rotating bracket assembly used to attach a new structural member to existing structural members.

Referring now to FIG. 9, bracket assembly 300 is shown for a roof addition application. Specifically, component 201 is secured by plurality of fasteners 1002 (e.g., three are shown although more or less could be used) to existing structural members 1 and 2. When adding on to an existing dwelling, it is often necessary to add a new roof that ties in and is supported by an existing roof. Accordingly, existing structural member 1 is an existing truss and structural member 2 is usually plywood. Structural member 3 is a new truss. The prior art requires removing shingles and plywood 2 to expose existing truss 1 so that new truss 3 can be tied in to existing truss 1.

Furthermore, the existing roof may be have been constructed at one angle from horizontal while the new roof may need to be constructed at another angle. The present invention solves all of these problems as the common base of component 201 is attached to existing members 2 and 3 using fasteners 1002 that pass through holes 201-13 (not visible in FIG. 9) in the common base. If placement of assembly 300 is temporary or uncertain, component 201 can be attached to existing members 2 and 3 just using holes 201-13 that are provided with tabs 201-12 that will keep the heads of fasteners 1002 raised slightly to facilitate their removal.

When existing shingles are removed from an existing roof to expose plywood member 2, the locations of existing trusses under plywood member 2 will be apparent from the nail pattern connecting the two. Thus, positioning and securing assembly 300 over an existing truss 1 without removal of plywood member 2 is straightforward.

Additional fasteners 1000 can be inserted through holes 101-7 to secure and support structural member 3 in component 101 while component 101 is still able to rotate. Once component 101/member 3 are rotated to their desired angular position, slots 201-9/holes 201-11 and some portions of 101-9 will be aligned and surround aligned holes 101-10 and 201-10. Fasteners may be placed through aligned ones of these slots and holes where the fasteners will engage structural member 3 to further secure assembly 300 to member 3 and stop rotation of component 101 and member 3 as desired.

When building the new addition, component 201 would be secured to existing members as described above. Structural member 3 would be placed into component 101. This will allow component 101 to rotate while supporting the new structural member without fasteners being used. Thus, the carpenter, homeowner, handyman, etc., is free to work on the positioning, measuring, nailing, etc., of the other end of structural member 3. With the invention secured to structural member 1, the positioning of the other end of the new member 3 can be established to determine the cut angle for new member 3.

Figure 10:
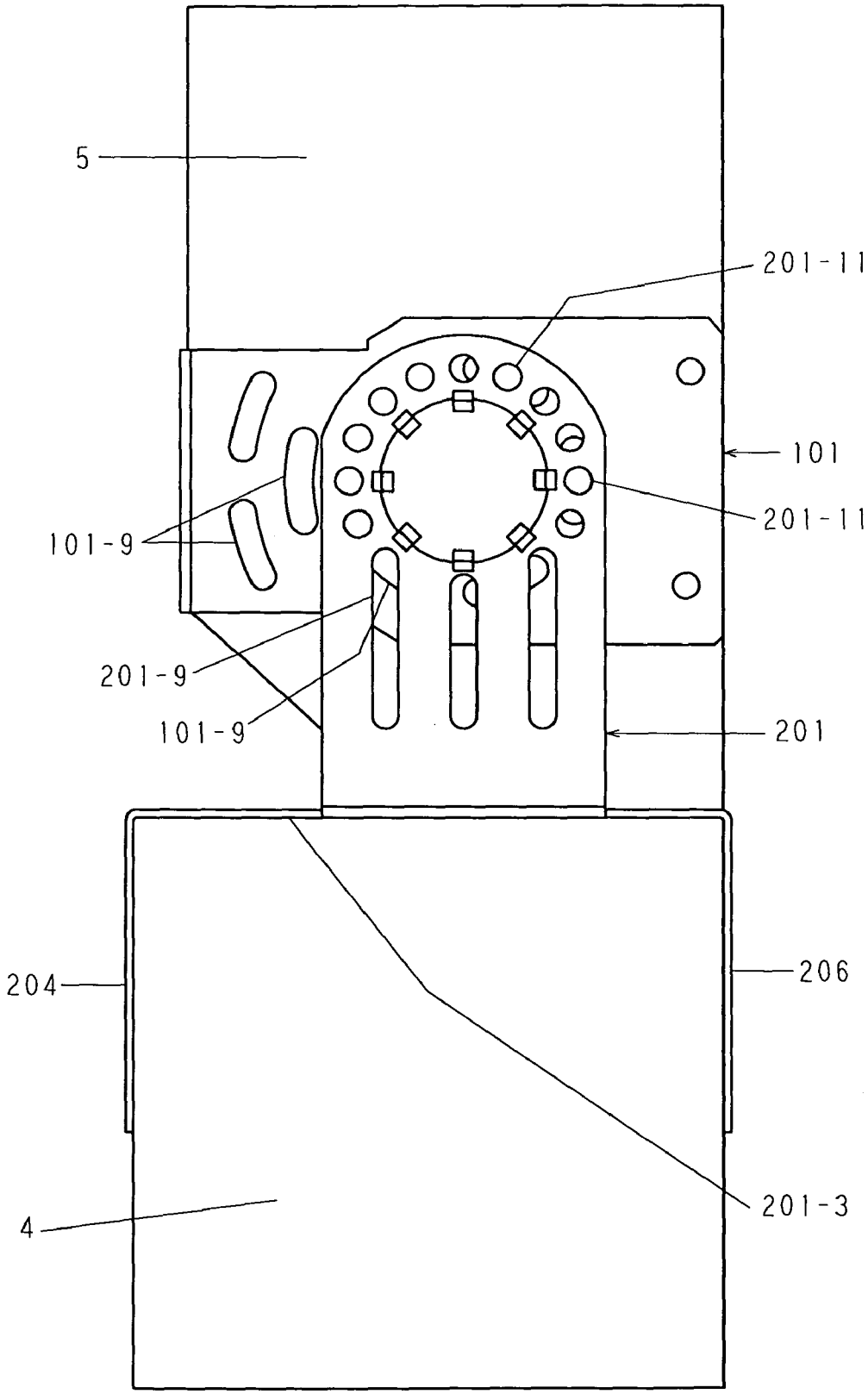
FIG. 10 is a side view of another embodiment of the rotating bracket assembly attached to two structural members.
Figure 11:
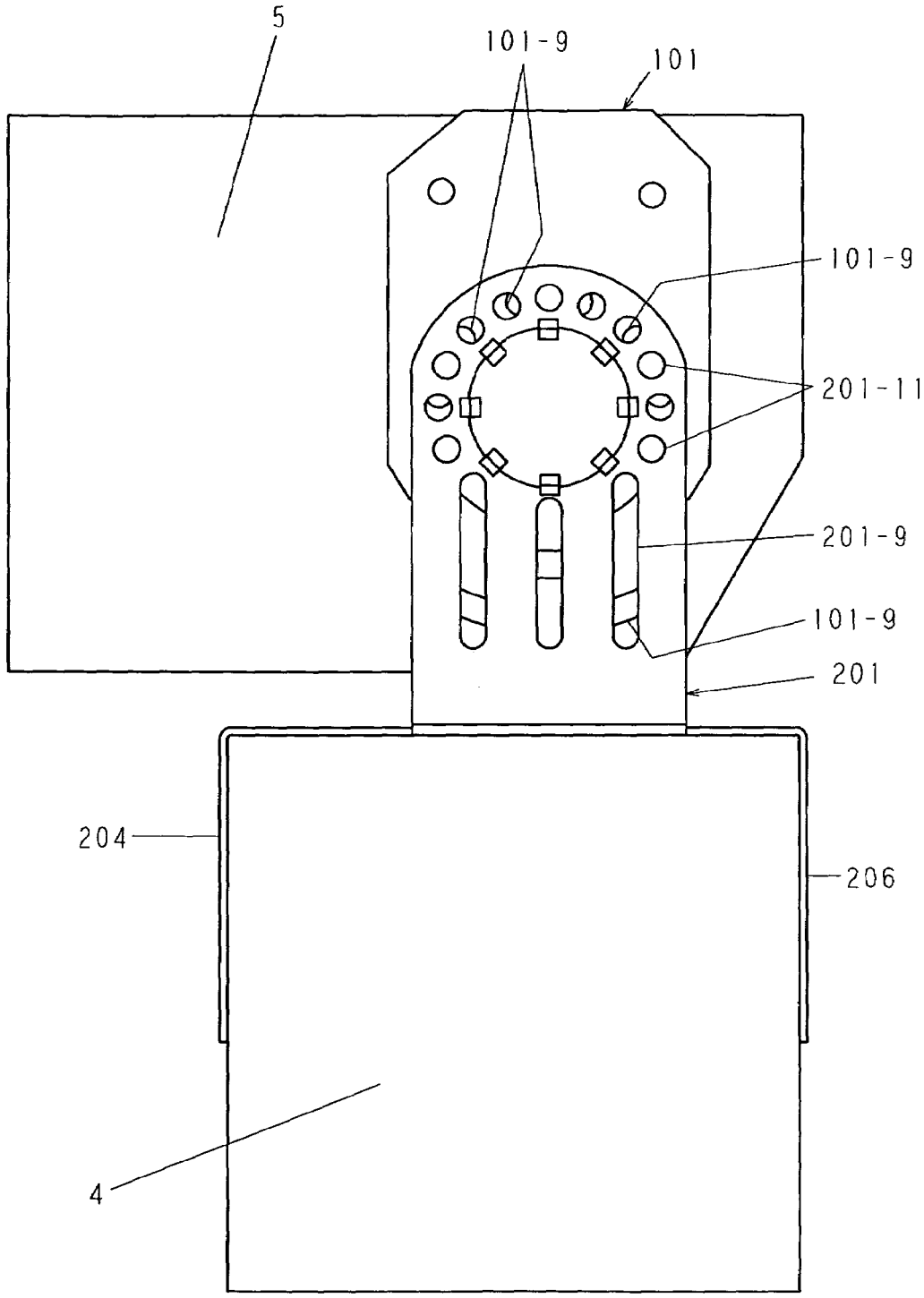
FIG. 11 is a side view of the FIG. 10 embodiment with the structural members rotated to a collapsed position.

FIGS. 10 and 11 illustrate another embodiment of the present invention and another application therefor. In this embodiment, the common base of component 201 is configured to define a second channel that faces substantially away from the first channel in which component 101 is nested. More specifically, surface 201-3 of component 201 forms the base surface of this second channel that includes opposing sides 204 and 206 with the spacing between sides 204 and 206 being designed to receive a structural member 4 therein. To make this embodiment more universally adaptable to variously-sized structural members, one of sides 204 and 206 could be omitted so that the second channel is only partially formed.

In either case, component 201 is attached to structural member 4 using fasteners (not shown) that pass through component 201 into member 4. Structural member 5 is pre-cut to its desired angle and attached to component 101 in ways described previously. Provided no fasteners are used in the aligned slots 201-9/holes 201-11 and holes 101-9, structural member 5 can be collapsed to a more compact relationship with structural member 4 as shown in FIG. 11. In this way, framing material can be cut off-site and packaged compactly for delivery to a construction site.

Once on-site, the structural members are simply rotated to their pre-engineered positioned and locked in place by inserting fasteners through assembly 300 and into structural member 5 as described above. The ability to rotate and collapse framing material in a designed configuration allows for a roof or wall to be collapsed when not needed to save space, and rotate into a functional position when the need arises.

The present invention is not limited to the specific embodiments described herein. For example, although components 101 or 111 are illustrated as open channels, the present invention could also be practiced if these components defined a closed channel sized to receive a certain size of framing material. The "top" of such a closed channel could be permanently fixed to both sides or just one side of the component in which case it could be bent to form the top of the channel once the framing material was placed therein.

The advantages of the present invention are numerous. The rotating bracket assembly can be used in off-site and on-site framing applications. The assembly allows frame structures to be engineered and assembled in a collapsed form to simplify delivery and ultimate on-site building fabrication. On-site framing is also improved as the rotating bracket assembly acts as a "third hand" to pre-position framing material to facilitate proper cutting thereof. Renovation/addition projects are simplified by reducing the amount of demolition required to tie a new frame structure into an existing frame structure.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A rotating bracket assembly, comprising:

a first member defining a first channel having opposing sides coupled to a common base;

a second member defining a second channel having opposing sides coupled to a common base;

said first member nested within said second member with each of said opposing sides of said first member being adjacent to one of said opposing sides of said second member and hingedly coupled thereto, wherein said first member can freely rotate 360° relative to said second member to a plurality of rotational positions; and said first member and said second member having holes formed therethrough in each of said opposing sides and said common base thereof wherein a first plurality of said holes in said opposing sides of said first member at least partially align with a second plurality of said holes in said opposing sides of said second member for each of said rotational positions, and wherein at least a portion of said first plurality of holes comprise slotted holes.

2. A rotating bracket assembly as in claim 1 wherein said common base of said first member is planar.

3. A rotating bracket assembly as in claim 1 wherein said common base of said second member is planar.

4. A rotating bracket assembly as in claim 1 further comprising at least one plate coupled to said common base of said second member and angularly disposed with respect thereto.

5. A rotating bracket assembly as in claim 1 wherein said first member is formed from a single piece of metal.

6. A rotating bracket assembly as in claim 1 wherein said second member is formed from a single piece of metal.

7. A rotating bracket assembly as in claim 1 wherein at least a portion of said second plurality of holes comprise slotted holes.

8. A rotating bracket assembly, comprising:

a first bracket shaped to define a first rectangular channel adapted to receive a portion of a framing element therein;

a second bracket shaped to define a second rectangular channel for receiving said first bracket therein to thereby form a nested relationship therewith, said first bracket hingedly coupled to said second bracket for full 360° rotation with respect thereto; and said first bracket and said second bracket having holes formed therethrough in each side thereof wherein each of a first plurality of said holes in said first bracket at least partially align with at least one of a second plurality of said holes in said second bracket at any rotational position of said first bracket, and wherein at least a portion of said first plurality of holes comprise slotted holes.

9. A rotating bracket assembly as in claim 8 wherein said second bracket is further shaped to define at least a portion of a third rectangular channel facing substantially away from said second rectangular channel.

10. A rotating bracket assembly as in claim 8 wherein said first bracket is formed from a single piece of metal.

11. A rotating bracket assembly as in claim 8 wherein said second bracket is formed from a single piece of metal.

12. A rotating bracket assembly as in claim 8 wherein at least a portion of said second plurality of holes comprise slotted holes.

13. A rotating bracket assembly as in claim 8 wherein each, of said first plurality of holes and said second plurality of holes comprises a straight slotted hole, and wherein each of said first plurality of holes is overlaid with at least one of said second plurality of holes while being angularly disposed with respect thereto at any rotational position of said first bracket.

14. A rotating bracket assembly, comprising:

a first bracket shaped to define a first rectangular channel adapted to receive a portion of a framing element therein;

a second bracket shaped to define a second rectangular channel for receiving said first bracket therein to thereby form a nested relationship therewith, said first bracket hingedly coupled to said second bracket for full 360 rotation with respect thereto about an axis of rotation passing perpendicularly through said first rectangular channel and said second rectangular channel; and said first bracket and said second bracket having holes formed therethrough in each side thereof wherein each of a first plurality of said holes in said first bracket is a slotted hole that at least partially aligns with at least one of a second plurality of said holes in said second bracket at any rotational position of said first bracket, said first plurality of holes and said second plurality of holes arrayed about said axis of rotation.

15. A rotating bracket assembly as in claim 14 wherein said second bracket is further shaped to define at least a portion of a third rectangular channel facing substantially away from said second rectangular channel.

16. A rotating bracket assembly as in claim 14 wherein each of said second plurality of holes comprises a slotted hole.

17. A rotating bracket assembly as in claim 14 wherein each of said first plurality of holes and said second plurality of holes comprises a straight slotted hole, and wherein each of said first plurality of holes is overlaid with at least one of said second plurality of holes while being angularly disposed with respect thereto at any rotational position of said first bracket.

* * * * *